US007685847B2

(12) United States Patent
Lee et al.

(10) Patent No.: US 7,685,847 B2
(45) Date of Patent: Mar. 30, 2010

(54) DRUM WASHING MACHINE

(75) Inventors: Chin Won Lee, Gwangmyeong-si (KR); Myung Sun Kang, Suwon-si (KR); Jang Hyuk Pang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 768 days.

(21) Appl. No.: 11/246,089

(22) Filed: Oct. 11, 2005

(65) Prior Publication Data

US 2006/0225466 A1 Oct. 12, 2006

(30) Foreign Application Priority Data

Apr. 6, 2005 (KR) ..... 10-2005-0028559

(51) Int. Cl.
*D06F 39/12* (2006.01)
*D06F 37/26* (2006.01)

(52) U.S. Cl. ..... 68/3 R; 68/140; 312/228

(58) Field of Classification Search ..... 68/3 R, 68/139, 140; 312/228, 228.1, 257.1, 263, 312/265.5, 265.6
See application file for complete search history.

(56) References Cited

U.S. PATENT DOCUMENTS

| | | | | |
|---|---|---|---|---|
| 2,296,265 | A * | 9/1942 | Russell | 68/3 R |
| 4,692,987 | A | 9/1987 | Cuthbert et al. | |
| 5,661,914 | A * | 9/1997 | Millet | 34/601 |
| 5,881,576 | A | 3/1999 | Davies, Jr. | |

FOREIGN PATENT DOCUMENTS

| | | |
|---|---|---|
| GB | 2 022 621 A | 12/1979 |
| JP | 8-238397 | 9/1996 |
| JP | 2000-61193 | 2/2000 |
| JP | 2001-212396 | 7/2001 |
| JP | 2003-93777 | 4/2003 |
| KR | 10-2004-74318 | 8/2004 |

OTHER PUBLICATIONS

The First Office Action issued on Oct. 10, 2008 by the State Intellectual Property Office of People's Republic of China in Application No. 200510106869.5, including the Details of the First Office Action (8 pages, with an additional 8 pages of English translation).

* cited by examiner

*Primary Examiner*—Joseph L Perrin

(57) ABSTRACT

A drum washing machine having an improved frame structure, the rigidity of which is reinforced. The drum washing machine includes side frames forming side surfaces thereof, where inclined planes are formed between front and upper surfaces of the side frames so that additional frames for reinforcing the rigidity of upper parts of the side frames are respectively connected to the upper surfaces of the side frames and upper regions of the front surfaces of the side frames. The drum washing machine further includes top brackets respectively connected to the upper surfaces, the inclined planes, and the upper regions of the front surfaces of the side frames for reinforcing the rigidity of upper parts of the side frames. The drum washing machine further includes a front frame, and a bottom panel or a top panel, connected to the side frames for reinforcing the rigidity of front, lower and upper parts of the side frames. The drum washing machine efficiently supports load increased according to large-scale and high-speed trends of the washing machine, and provides a frame structure capable of withstanding all loads without using a sheathing member, thus having various designs without limit.

5 Claims, 5 Drawing Sheets

DRUM WASHING MACHINE

CROSS REFERENCE TO RELATED APPLICATION

This application claims the benefit of Korean Patent Application No. 10-2005-28559, filed Apr. 6, 2005 in the Korean Intellectual Property Office, the disclosure of which is incorporated herein by reference.

BACKGROUND OF THE INVENTION

1. Field of the Invention

The present invention relates to a drum washing machine, and more particularly, to a frame structure of a drum washing machine having improved rigidity characteristics of the frame so that the design of the drum washing machine can be variously modified.

2. Description of the Related Art

A drum washing machine washes laundry by rotating a drum-type washing tub using a motor so as to lift and drop the laundry and washing water and to generate friction between the laundry and the washing water. Generally, the drum washing machine includes a frame for forming the overall external appearance of the washing machine and supporting internal components, such as the drum-type washing tub.

As recent drum washing machines have been developed to have a large size and increase the rotational speed of the washing tub installed therein, the weights of the internal components and force generated and transmitted from a motor have increased. Accordingly, the research and development of a technique for maintaining and reinforcing the rigidity of a frame against dynamic excitation load generated from an internal rotating body as well as the rigidity of the frame against static load applied from the outside has been required. The present invention is designed to satisfy the above requirement.

Korean Patent Laid-open Publication No. 2004-74318 discloses a frame structure of a conventional drum washing machine.

As shown in FIG. 1, the frame structure of the conventional drum washing machine includes a main frame 1 including a rear frame 2 and two side frames 3, a first front frame 4 and a second front frame 5 positioned in front of the main frame 1 and respectively connected to upper and lower ends of the two side frames 3, and spring brackets 6 respectively connected to upper surfaces of the two side frames 3 for supporting springs buffering vibration generated due to the rotation of an internal component.

In the above frame structure of the conventional drum washing machine, the first front frame 4 and the second front frame 5 support only the upper and lower ends of the main frame 1. Accordingly, when external force is applied to the frame structure or rotary force from the internal rotating component is applied to the frame structure, the frame structure cannot maintain sufficient rigidity against distortion. Further, when concentrated load having a small area of force is applied between the first front frame 4 and the second front frame 5, the side frames 3 are easily warped.

Moreover, the frame structure of the conventional drum washing machine does not have frames installed on opened upper and lower portions of the main frame 1 for reinforcing the rigidity of the frame structure, thus having the low rigidity of upper and lower portions of the washing machine.

Consequently, the conventional drum washing machine requires sheathing members, such as a top cover 7 and a door panel 8, serving to maintain the rigidity. The sheathing members severely limit the design freedom of the drum washing machine so as to satisfy consumer's requirements.

In the conventional frame structure, the spring brackets 6 support only springs, and do not sufficiently reinforce the rigidity of the main frame 1, thus being incapable of sufficiently reinforcing the rigidity of upper corners of the main frame 1.

The above problem is severe, as drum washing machine products are large-sized and a rotating body in the drum washing machine products is rotated at a high speed. Accordingly, in order to upgrade the drum washing machine products and design the products to meet consumer's various requirements, this problem must be solved first.

SUMMARY OF THE INVENTION

Additional aspects and/or advantages of the invention will be set forth in part in the description which follows and, in part, will be apparent from the description, or may be learned by practice of the invention.

Therefore, one aspect of the invention is to provide a drum washing machine having an improved frame structure, the rigidity of which is sufficiently maintained to achieve various external designs of the washing machine.

In accordance with one aspect, the present invention provides a drum washing machine including side frames forming side surfaces thereof, where inclined planes are formed between front and upper surfaces of the side frames so that additional frames for reinforcing the rigidity of upper parts of the side frames are respectively connected to the upper surfaces of the side frames and upper regions of the front surfaces of the side frames.

The drum washing machine may further include top brackets respectively connected to the upper surfaces, the inclined planes, and the upper regions of the front surfaces of the side frames for reinforcing the rigidity of upper parts of the side frames.

The drum washing machine may further include a front frame connected to the front surfaces of the side frames, and a bottom panel connected to lower parts of the side frames.

The bottom panel may include a horizontal portion connected to the lower surfaces of the side frames, and a vertical portion bent upwardly from one end of the horizontal portion and connected to the front surfaces of the side frames, and the horizontal portion and the vertical portion may be integrally formed.

The drum washing machine may further include a top panel connected to the upper parts of the top brackets for reinforcing the upper parts of the side frames. Here, the top panel may be connected to the upper surfaces of the top brackets, or may pass through the top brackets and be connected to the side frames.

The front frame may be connected to the front surfaces of the side frames from portions thereof on the vertical portion to portions thereof adjacent to the top brackets so as to efficiently maintain the rigidity against force applied from the front of the side frames in the lateral direction, and may have an approximately regular tetragonal plate shape.

The front parts of the side frames may be bent inwardly towards an inner space, formed by the frames, to form the front surfaces of the side frames, and then be bent again backwardly such that the side frames have 'C'-shaped cross sections.

Each of the top brackets may include a guide protrusion for allowing the top bracket to be connected to a precise position of the corresponding side frame, and the top bracket may be guided by the guide protrusion and fixed to the side frame using a screw and by caulking.

In accordance with another aspect, the present invention provides a drum washing machine having a frame structure including: a first frame including side frames and a rear frame respectively forming side surfaces and a rear surface of the washing machine; a second frame connected to front surfaces of the side frames; a third frame connected to lower parts of the side frames and a lower part of the second frame; and a pair of fourth frames connected to upper surfaces and parts of the front surfaces of both side frames of the first frame for reinforcing an upper part of the first frame.

The frame structure may further include a fifth frame connected to upper parts of the fourth frames, or passing through the fourth frames and connected to the side frames, for reinforcing upper parts of the side frames.

Inclined planes may be formed between front surfaces and upper surfaces of the side frames.

BRIEF DESCRIPTION OF THE DRAWINGS

These and/or other aspects and advantages of the invention will become apparent and more readily appreciated from the following description of the embodiments, taken in conjunction with the accompanying drawings in which.

DETAILED DESCRIPTION OF THE PREFERRED EMBODIMENTS

Figure 1:
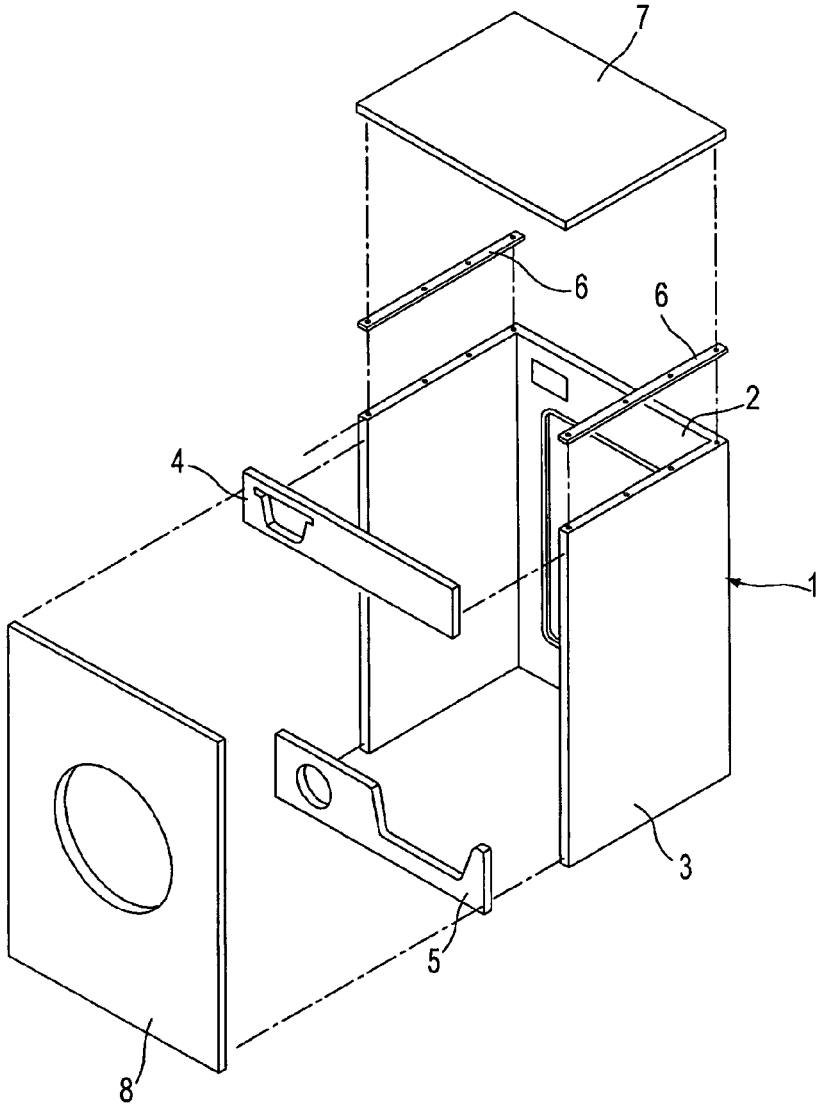
FIG.1 (PRIOR ART)
FIG. 1 is an exploded perspective view illustrating a frame structure of a conventional drum washing machine.

Reference will now be made in detail to the embodiment of the present invention, an example of which is illustrated in the accompanying drawings, wherein like reference numerals refer to like elements throughout. The embodiment is described below to explain the present invention by referring to the annexed drawings.

Figure 2:
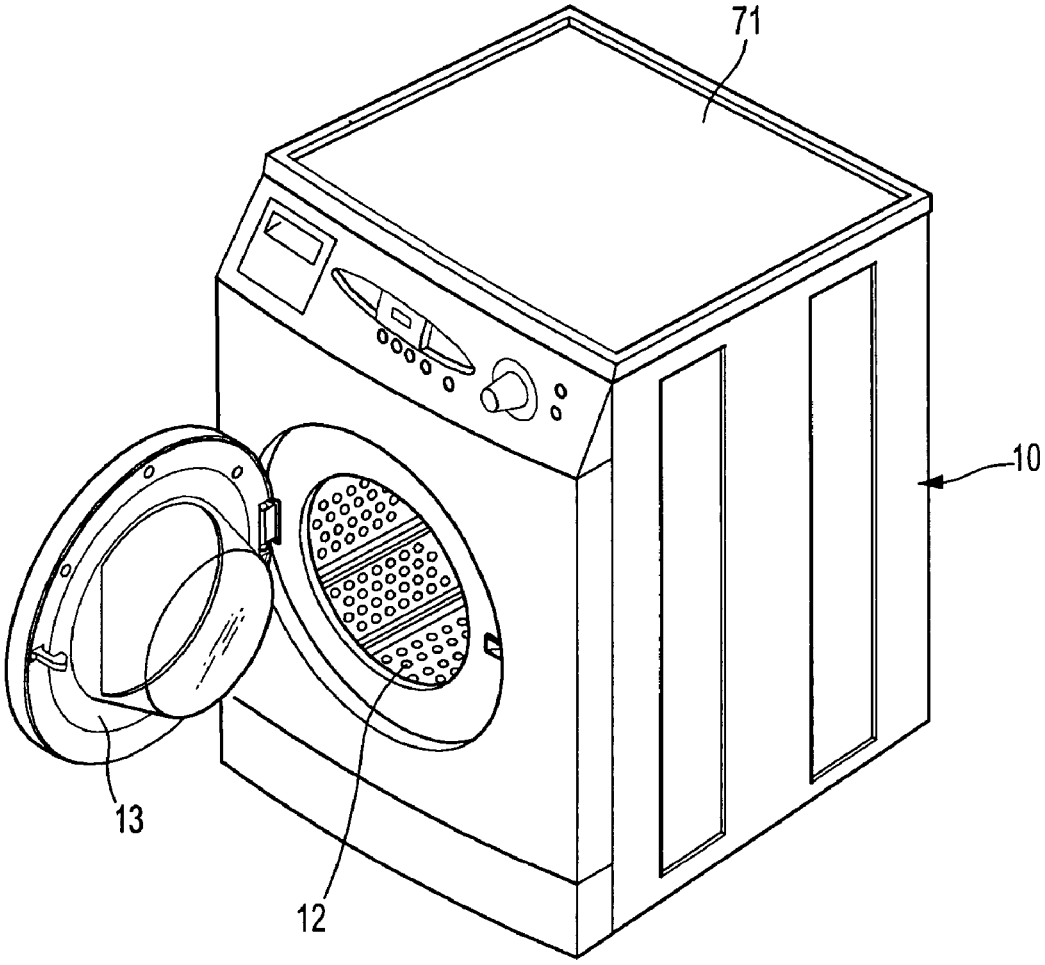
FIG. 2 is a perspective view of a drum washing machine of the present invention.
Figure 3:
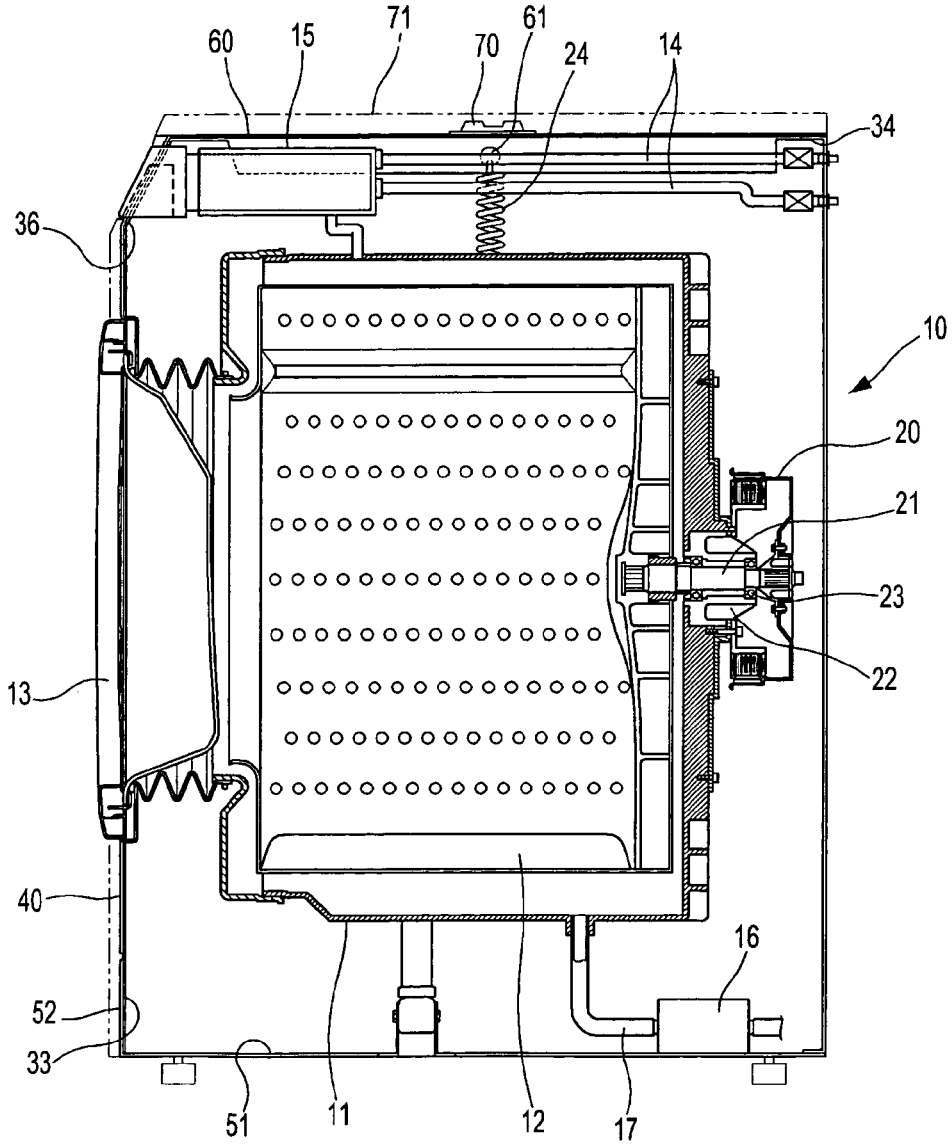
FIG. 3 is a longitudinal sectional view of the drum washing machine of the present invention.

FIG. 2 is a perspective view of a drum washing machine of the present invention. FIG. 3 is a longitudinal sectional view of the drum washing machine of the present invention.

As shown in FIGS. 2 and 3, the drum washing machine of the present invention includes a housing 10 forming the external appearance of the drum washing machine, a tub 11 installed in the housing 10 for containing washing water, a drum 12 rotatably installed in the tub 11 for containing laundry to be washed, and a door 13 installed on the front surface of the housing 10 for opening and closing the opened front surface of the housing 10.

A water supply pipe 14 for supplying washing water to the tub 11 and a detergent supply device 15 for supplying detergent to the tub 11 are installed in the upper portion of the housing 10. A drainage pump 16 and a drainage pipe 17 for discharging the washing water contained in the tub 11 to the outside of the housing 10 are installed in the lower portion of the housing 10.

A driving motor 20 for rotating the drum 12 in a regular or reverse direction is installed outside the tub 11, and a rotary shaft 21 for transmitting the rotary force of the driving motor 20 to the drum 12 is installed between the drum 12 and the driving motor 20. A bearing housing 22 for rotatably supporting the rotary shaft 21 is installed on the rear surface of the tub 11, and a bearing 23 is installed between the bearing housing 22 and the outer surface of the rotary shaft 21. A spring 24 for buffering the vibration of the tub 11 is fixedly installed on the upper portion of the tub 11.

The housing 10 protecting the above internal components and forming the overall external appearance of the washing machine has a frame structure, as follows.

Figure 4:
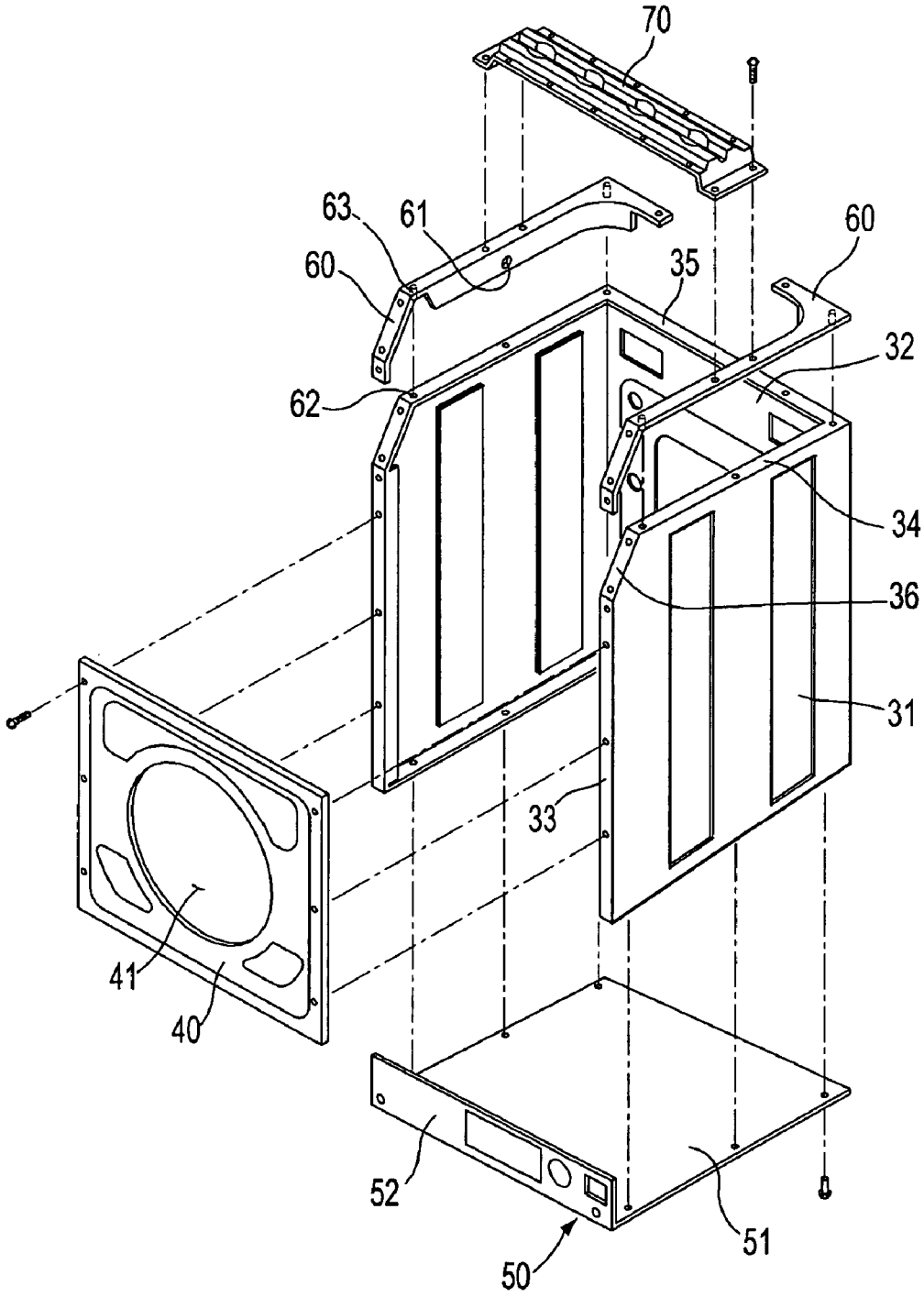
FIG. 4 is an exploded perspective view illustrating a frame structure of the drum washing machine of the present invention.
Figure 5:
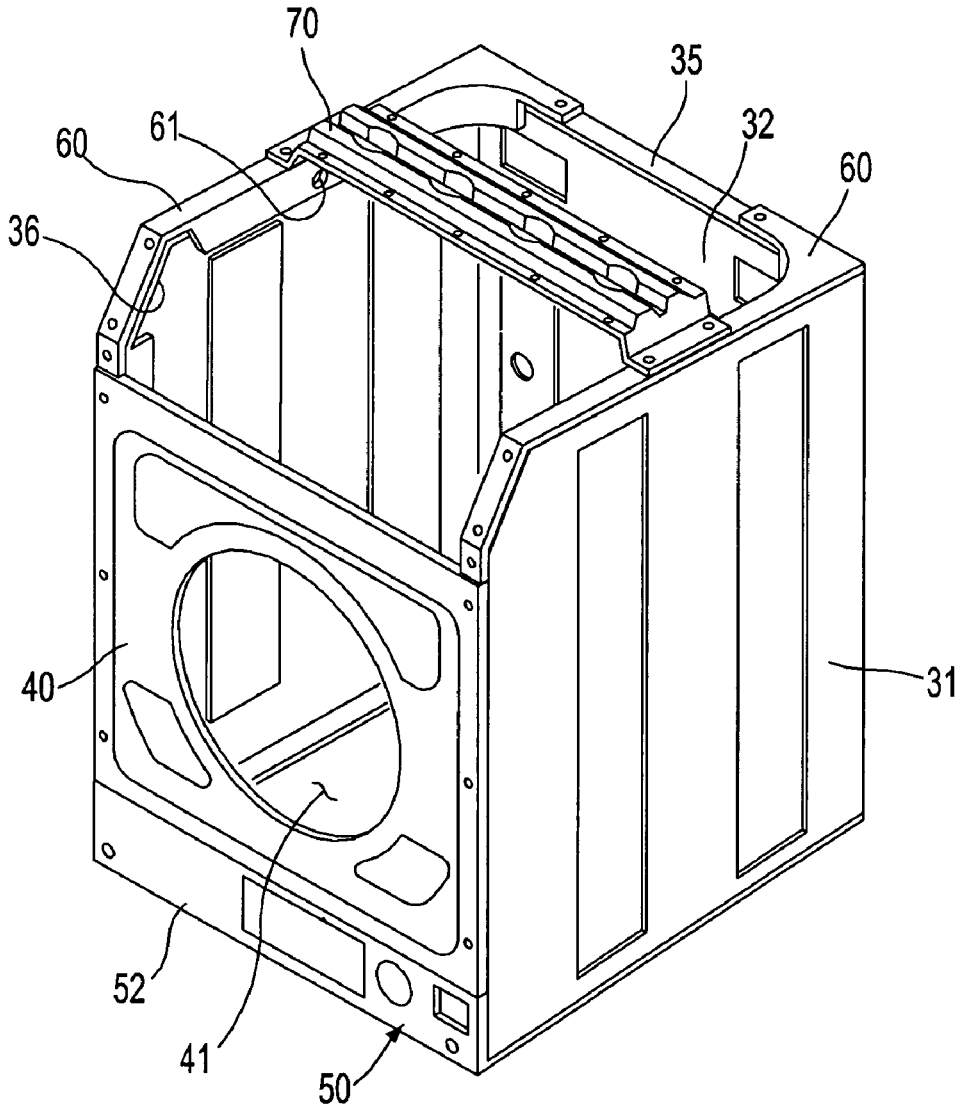
FIG. 5 is an assembled perspective view illustrating the frame structure of the drum washing machine of the present invention.

FIGS. 4 and 5 are exploded and assembled perspective views illustrating the frame structure of the drum washing machine of the present invention. As shown in FIGS. 4 and 5, the frame structure of the drum washing machine includes side frames 31 and a rear frame 32 respectively forming the side and rear surfaces of the structure, a front frame 40 connected to the front surfaces of the side frames 31, a bottom panel 50 connected to the lower surfaces of the side frames 31, and top brackets 60 connected to the upper surfaces and the upper parts of the front surfaces of the side frames 31 for reinforcing the rigidity of upper corners of the side frames 31.

Generally, the side frames 31 and the rear frame 32 are integrally manufactured by pressing and bending one steel plate. All sides of the side frames 31 and the rear frame 32 are bent inwardly towards an inner space formed by the frames 31 and 32 to produce bent planes having a designated width so that the front frame 40, the bottom panel 50, and the top brackets 60 are easily connected to the side frames 31 and the rear frame 32. For example, the vertical front sides of both side frames 31 are bent inwardly, thereby forming front surfaces 33 of the side frames 31. The horizontal upper sides of the side frames 31 and the rear frame 32 are bent inwardly, thereby forming upper surfaces 34 of the side frames and an upper surface 35 of the rear frame 32. Preferably, the front surfaces 33 of the side frames 31 are bent backwardly one more time such that the side frames 31 have 'C'-shaped cross sections, thus maintaining the rigidity against load applied in the vertical direction.

Inclined planes 36 for connecting the front surfaces 33 and the upper surfaces 34 of the side frames 31 are formed on the side frames 31. A control unit is mounted on a panel installed on the inclined planes 36, thereby allowing a user in a comfortable position to control the washing machine, and causing the top brackets 60 to be connected to larger areas of the upper corners of the side frames 31 so that the top brackets 60 reinforce the rigidity of the structure.

The bottom panel 50 includes a horizontal portion 51 connected to the lower surfaces of the side frames 31, and a vertical portion 52 bent upwardly from one end of the horizontal portion 51 and connected to the front surfaces 33 of the side frames 31. The horizontal portion 51 and the vertical portion 52 may be integrally formed so as to reduce the number of components of the structure to reduce the production costs of the structure, to improve the assembling efficiency of the structure, and to further reinforce the rigidity of the lower portion of the structure. Further, the bottom panel 50 may be made of an electroplated zinc steel plate having a thickness of 1.4 mm-2.0 mm. The bottom panel 50 may be connected to the side frames 31 by rivets and caulks.

Both top brackets 60 are connected to a part of the upper surface 35 of the rear frame 32, and the upper surfaces 34, the inclined planes 36, and parts of the front surfaces 33 of the side frames 31. As described above, the top brackets 60 reinforce the large areas of the upper corners of the side frames, on which loads applied from several directions are concentrated, thereby reinforcing the rigidity of the overall structure of a product. Particularly, the top brackets 60 are not connected to the upper and front surfaces 34 and 33 of the side frames 31 under the condition that portions of the top brackets 60 at positions of the interfaces between the upper and front surfaces 34 and 33 of the side frames 31 are bent at an angle of 90 degrees, but are connected to the side frames 31 along the upper surfaces 34, the inclined planes 36, and the front surfaces 33 of the side frames 31. Thereby, the top brackets 60 have large supporting areas, and disperse load.

Each of the top brackets 60 includes a guide protrusion 63 for allowing the top bracket 60 to be easily and precisely assembled with the corresponding side frame 31. The guide protrusion 63 is inserted into a guide hole 62 formed at a corresponding position of the side frame 31, thereby guiding the connecting position of the top bracket 60. When the connecting position of the top bracket 60 to the side frame 31 is set by the guide protrusion 63 as described above, the top bracket 60 is temporarily assembled with the side frame 31 by a screw, and is then connected to the side frame 31 by caulking.

A spring fixing hole 61 for supporting one end of a spring 24 for buffering the vibration of the tub 11 is formed in the top bracket 60. The spring fixing hole 61 serves to fix the spring 24 as well as to reinforce the rigidity of the frame structure.

The front frame 40 is connected to the front surfaces 33 of the side frames 31 on the vertical portion 52 of the bottom panel 50 so as to maintain rigidity against force applied from the front of the side frames 31 in the lateral direction. The front frame 40 may be connected also to the vertical portion 52 of the bottom panel 50 by fixing means, such as bolts. The front frame 40 may have an approximately regular tetragonal plate shape so that the front frame 40 is not connected to parts of the front surfaces 33 of the side frames 31 in consideration of the position of an opening for placing laundry in the drum 12 as described in the conventional washing machine, but is connected to most of the front surfaces 33 of the side frames 31. Here, an opening 41 for placing laundry in the frame structure is formed through the front frame 40. As described above, the connection of the front frame 40 to the large regions of the front surfaces 33 of the side frames 31 reinforces the rigidity of the structure against load applied in the lateral direction and distortion load rather than the connection of two frames to upper and lower portions of the side frames. Preferably, the front frame 40 is manufactured by pressing a steel plate having a thickness of 0.6 mm-1.2 mm, and is connected to the side frames 31 by screws.

A top panel 70 is connected to the upper surfaces of the top brackets 60. The top panel 70 is connected to the upper surfaces of both side frames 31, and serves to reinforce the rigidity of the structure against force applied from above the side frames 31 in the lateral direction and to support a top cover 71 (with reference to FIG. 2) covering the top panel 70. The top panel 70 may be connected to the top brackets 60 by fixing means, such as screws, or may pass through the top brackets 60 and be directly connected to the side frames 31.

As apparent from the above description, the present invention provides a drum washing machine having a frame structure, in which inclined planes are formed between upper and front surfaces of side frames so that top brackets for reinforcing the rigidity of upper corners of the side frames are connected to large regions of the side frames, and a lower panel and a front frame for reinforcing the rigidity of the lower and front surfaces of the side frames are installed, thereby reinforcing the overall rigidity of the frame structure.

Accordingly, the drum washing machine of the present invention efficiently supports load increased according to large-scale and high-speed trends of the washing machine, and causes the frame structure to withstand all loads without using a sheathing member, thus having various designs without limit and satisfying consumer's requirements.

Although the embodiment of the invention has been shown and described, it would be appreciated by those skilled in the art that changes may be made in this embodiment without departing from the principles and spirit of the invention, the scope of which is defined in the claims and their equivalents.

What is claimed is:

1. A drum washing machine having a frame structure comprising:

a first frame including side frames and a rear frame respectively forming side surfaces and a rear surface of the washing machine, inclined planes being formed between the front surfaces and the upper surfaces of the side frames;

a second frame connected to front surfaces of the side frames forming a front surface of the washing machine;

a third frame connected to lower parts of the side frames and a lower part of the second frame forming a bottom of the washing machine; and a pair of top brackets, each of the top brackets being connected on opposite sides of the first frame to reinforce an upper part of the first frame, each of the top brackets being connected to a part of the upper surface of the rear frame, an entire upper surfaces of the side frame, the inclined plane, and parts of the front surface of the side frames, respectively; and a top frame connected to upper parts of the top brackets to reinforce upper parts of the side frames.

2. The drum washing machine as set forth in claim 1, wherein:

the third frame includes a horizontal portion connected to lower surfaces of the side frames, and a vertical portion bent upwardly from one end of the horizontal portion and connected to the front surfaces of the side frames; and the horizontal portion and the vertical portion are integrally formed.

3. The drum washing machine as set forth in claim 1, wherein the second frame is connected to the front surfaces of the side frames from portions thereof on the third frame to portions thereof adjacent to the fourth frames so as to efficiently maintain the rigidity against force applied from the front of the first frame in the lateral direction.

4. The drum washing machine as set forth in claim 1, wherein the front parts of the side frames are bent inwardly towards an inner space, formed by the first frame, to form front surfaces of the side frames, and are then bent again backwardly such that the side frames have 'C'-shaped cross sections.

5. The drum washing machine as set forth in claim 1, wherein the side frames and the rear frame of the first frame are integrally formed.

* * * * *